US009796950B2

(12) United States Patent
Foster et al.

(10) Patent No.: US 9,796,950 B2
(45) Date of Patent: Oct. 24, 2017

(54) SYNERGISTIC STAIN REMOVAL THROUGH AN ALKALI METAL HYDROXIDE-BASED DETERGENT COMPOSITION WITH NOVEL CHELATOR COMBINATION

(71) Applicant: Ecolab USA Inc., St. Paul, MN (US)

(72) Inventors: Tobias Foster, Cologne (DE); John Mansergh, Cottage Grove, MN (US); Lee J. Monsrud, Inver Grove Heights, MN (US); Shigeaki Yamada, Saitama (JP); Dan N. Tallman, New Brighton, MN (US); Marc Von Bergen, Apple Valley, MN (US)

(73) Assignee: Ecolab USA Inc., Saint Paul, MN (US)

( * ) Notice: Subject to any disclaimer, the term of this patent is extended or adjusted under 35 U.S.C. 154(b) by 0 days.

(21) Appl. No.: 14/917,783

(22) PCT Filed: Sep. 9, 2013

(86) PCT No.: PCT/EP2013/068625

§ 371 (c)(1),
(2) Date: Mar. 9, 2016

(87) PCT Pub. No.: WO2015/032451

PCT Pub. Date: Mar. 12, 2015

(65) Prior Publication Data

US 2016/0222320 A1 Aug. 4, 2016

(51) Int. Cl.

| | |
|---|---|
| ***C11D 3/06*** | (2006.01) |
| ***C11D 3/33*** | (2006.01) |
| ***C11D 9/14*** | (2006.01) |
| ***C11D 3/04*** | (2006.01) |
| ***C11D 7/06*** | (2006.01) |
| ***C11D 7/16*** | (2006.01) |
| ***C11D 7/32*** | (2006.01) |
| ***C11D 3/37*** | (2006.01) |

(52) U.S. Cl.
CPC ..... *C11D 3/33* (2013.01); *C11D 3/044* (2013.01); *C11D 3/06* (2013.01); *C11D 3/3765* (2013.01); *C11D 7/06* (2013.01); *C11D 7/16* (2013.01); *C11D 7/3245* (2013.01)

(58) Field of Classification Search
CPC ..... C11D 3/0094; C11D 3/0047; C11D 3/044; C11D 3/06; C11D 3/1226; C11D 3/33; C11D 3/362; C11D 9/14
See application file for complete search history.

(56) References Cited

U.S. PATENT DOCUMENTS

| | | | | |
|---|---|---|---|---|
| 6,165,970 | A * | 12/2000 | Williams | C11D 3/33 510/223 |
| 8,623,804 | B2 * | 1/2014 | De Leersnyder | C11D 1/83 510/218 |
| 2005/0043205 | A1 * | 2/2005 | Bettiol | C11D 3/2072 510/475 |
| 2010/0163076 | A1 * | 7/2010 | Zipfel | C11D 3/37 134/25.2 |
| 2013/0071913 | A1 * | 3/2013 | Andersen | C11D 3/38609 435/264 |
| 2013/0079268 | A1 * | 3/2013 | Eiting | C11D 3/38663 510/221 |
| 2017/0037387 | A1 * | 2/2017 | Cascao-Pereira | C12N 9/2414 |

FOREIGN PATENT DOCUMENTS

| | | | |
|---|---|---|---|
| JP | 2006335908 | A | 12/2006 |
| JP | 2010144087 | A | 7/2010 |

* cited by examiner

*Primary Examiner* — Charles Boyer
(74) *Attorney, Agent, or Firm* — McKee, Voorhees & Sease, PLC

(57) ABSTRACT

The invention relates to a concentrated detergent composition comprising an alkali metal hydroxide, methylglycinediacetic acid, glutamic acid N,N-diacetic acid, and alkali metal tripolyphosphate. The composition is particularly suited to remove tea and coffee soil in warewashing applications.

14 Claims, No Drawings

SYNERGISTIC STAIN REMOVAL THROUGH AN ALKALI METAL HYDROXIDE-BASED DETERGENT COMPOSITION WITH NOVEL CHELATOR COMBINATION

The present invention relates to concentrated detergent compositions comprising a mixture of chelators (complexing agents) for warewashing, especially adapted for the removal of tea and coffee soil.

It is known in the field of detergent chemistry that calcium and magnesium ions usually present in hard water can react with components of detergent compositions to form insoluble precipitates. This is a highly unfavorable effect as it causes the formation of scale on cleaned goods and negatively effects the detergent's capacity to remove soil.

Detergents therefore commonly comprise complexing agents that bind to metal ions and thereby reduce the concentration of free metal ions in aqueous systems. Most complexing agents act as polydentate ligands to form chelate complexes with the metal ions. Commonly used complexing agents are, for example, phosphates, citric acid, gluconic acid, methylglycinediacetic acid (MGDA), nitrilotriacetic acid (NTA), ethylenediaminetetraacetic acid (EDTA), diethylenetriaminepentaacetic acid (DTPA), hydroxyethylenediaminetriacetic acid (HEDTA), or iminodisuccinate (IDS).

By binding free magnesium or calcium ions, complexing agents reduce water hardness and prevent scale from forming. Complexing agents can also even help to redissolve scale by sequestering magnesium or calcium ions that are bound to and stabilize precipitated scale. Complexing agents thus serve a dual role by both reducing water hardness and redissolving scale. Complexing agents further may prevent metal ions from participating in typical chemical reactions, for example the chemical decomposition of peroxide compounds catalyzed by manganese, iron and copper ions. Complexing agents are therefore particularly used to enhance the performance of cleaning compositions comprising peroxide bleaches.

To optimize the amount of complexing agent included in a detergent composition, the minimal amount of complexing agent required to achieve a certain cleaning performance is usually determined in a standardized cleaning test. This minimal concentration is also called the breakpoint concentration. For mixtures of complexing agents, it is assumed that the contributions of the individual agents are additive such that the required amount of each agent in the mixture can be calculated based on the individual breakpoint concentrations.

Complexing agents are selected based on their calcium binding capacity, metal binding capacity in general, and their cost. In addition properties such as toxicology, detergent compatibility, and environmental restrictions have also to be considered. To make the use of complexing agents as cost efficient as possible, it is desirable to minimize the amount of complexing agent needed for a given application. There is therefore the need to increase the efficiency of the complexing agents.

The present invention deals with alkaline detergent compositions for the removal of tea and coffee soil in warewashing applications. Alkaline detergents are formulated on the basis of alkali hydroxide as an alkaline source, in particular sodium hydroxide. Tea and coffee soil is thought to comprise oxidized polyphenols (e.g. tannins) bridged by calcium silicate. This type of soil has proven to be particularly difficult to dissolve. It is therefore the object of the present invention to provide a highly efficient detergent composition for the removal of tea and coffee soil in warewashing applications.

It has surprisingly been found that the combination of the complexing agents methylglycinediacetic acid (MGDA) and/or glutamic acid N,N-diacetic acid (GLDA) and sodium tripolyphosphate (STPP) exhibits synergy in an alkali metal hydroxide based detergent composition with regard to the removal of tea and coffee stains. By synergy it is meant that the total concentration of the two or three complexing agents required to achieve a cleaning effect is lower than what would be expected based on each agent's individual breakpoint concentration. This allows to minimize the amount of complexing agents used in a detergent composition.

The present invention therefore provides a concentrated detergent composition comprising alkali metal hydroxide, alkali metal tripolyphosphate, and at least one complexing agent selected from the group consisting of methylglycinediacetic acid and glutamic acid N,N-diacetic acid.

In general, the concentrated detergent composition comprises an effective amount of alkali metal hydroxide. In the context of the present invention, an effective amount of the alkali metal hydroxide is an amount that provides a use solution having a pH of at least 9, more preferably a pH of 10.5 to 12, most preferably 11 to 11.8. measured at room temperature (20° C.). For the purpose of determining the pH of the use solution, this use solution is defined as a solution of 1 g of the concentrated detergent composition dissolved in 1 liter distilled water.

To provide the required alkalinity, the concentrated detergent composition typically comprises at least 5% by weight alkali metal hydroxide, preferably the composition comprises 10 to 80% by weight, more preferably 15 to 70% by weight, most preferably 20 to 60% by weight alkali metal hydroxide.

Suitable alkali metal hydroxides are for example sodium or potassium hydroxide, with sodium hydroxide being particularly preferred.

Due to the use of an alkali metal hydroxides as alkaline source, other alkaline sources such as alkali metal carbonates are not required. Preferably, the concentrated detergent composition therefore comprises not more than 10% by weight alkali metal carbonates, preferably not more than 5% by weight. In another preferred embodiment, the concentrated detergent composition does not comprise any alkali metal carbonate.

The concentrated detergent composition comprises alkali metal tripolyphosphate and at least one of methylglycinediacetic acid (MGDA) and glutamic acid N,N-diacetic acid (GLDA) as the complexing agents. In a preferred embodiment, the concentrated detergent composition comprises, alkali metal triphosphate and both methylglycinediacetic acid (MGDA) and glutamic acid N,N-diacetic acid (GLDA).

In the context of the present invention, MGDA and GLDA may be used as free acids or as salts. Commonly, the sodium salts of the mentioned compounds will be included in the detergent compositions. The alkali metal tripolyphosphate preferably is sodium tripolyphosphate (STPP).

The complexing agents are readily available to the person skilled in the art. For example, the trisodium salt of MGDA is sold under the trademark Trilon M by BASF, and the tetrasodium salt of GLDA is available under the trademark Dissolvine GL from AkzoNobel.

The concentration of the two or three complexing agents is usually adjusted based on the amount of alkali metal hydroxide present, such that upon dilution of the concentrated composition suitable working concentrations of both the alkali metal hydroxide and the complexing agents are obtained. Preferably, the molar ratio of the sum of alkali metal tripolyphosphate, MGDA, and GLDA to alkali metal hydroxide is 0.01 to 1, more preferably 0.05 to 0.3, most preferably 0.06 to 0.2.

The relative amounts of the two or three complexing agents may be adjusted in order to maximize the cleaning efficiency.

Preferably, the molar ratio of alkali metal tripolyphosphate to the sum of alkali metal tripolyphosphate, MGDA, and GLDA is 0.05 to 0.95, more preferably 0.5 to 0.9, most preferably 0.8 to 0.9.

If MGDA is included, the molar ratio of MGDA to the sum of alkali metal tripolyphosphate, MGDA, and GLDA preferably is 0.05 to 0.95, more preferably 0.05 to 0.5, most preferably 0.05 to 0.25.

If GLDA is included, the molar ratio of GLDA to the sum of alkali metal tripolyphosphate, MGDA, and GLDA preferably is 0.05 to 0.95, more preferably 0.05 to 0.5, most preferably 0.05 to 0.25.

In another preferred embodiment the total concentration of alkali metal tripolyphosphate, MGDA, and GLDA is 1 to 60% by weight based on the total weight of the concentrated detergent composition, more preferably 15 to 45% by weight, most preferably 20 to 35% by weight. The amount of GLDA preferably is 0.05 to 20% by weight based on the total weight of the concentrated detergent composition, more preferably 1 to 10% by weight, most preferably 1 to 8% by weight. The amount of MGDA preferably is 0.05 to 20% by weight based on the total weight of the concentrated detergent composition, more preferably 1 to 10% by weight, most preferably 1 to 8% by weight. The amount of alkali metal tripolyphosphate preferably is 1 to 50% by weight based on the total weight of the concentrated detergent composition, more preferably 10 to 40% by weight, most preferably 20 to 35% by weight. It should be noted that the above weight % calculations are based on active concentrations of each compound. i.e. based on 100% activity, not based on the activity as received from the raw material supplier.

The concentrated detergent composition of the present invention may further comprise at least one of the compounds selected from the list consisting of surfactants, bleaching agents, activating agents, chelating/sequestering agents, silicates, detergent fillers or binding agents, defoaming agents, anti-redeposition agents, enzymes, dyes, odorants, catalysts, threshold polymers, soil suspension agents, antimicrobials, and mixtures thereof.

A variety of surfactants can be used in the present composition, such as anionic, nonionic, cationic, and zwitterionic surfactants. The concentrated detergent composition can comprise 0.5 to 20% by weight surfactant based on the total weight of the concentrated detergent composition, preferably 1.5 to 15% by weight.

Suitable anionic surfactants are, for example, carboxylates such as alkylcarboxylates (carboxylic acid salts) and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, alkylether sulfates; and phosphate esters such as alkylphosphate esters. Exemplary anionic surfactants include sodium alkylarylsulfonate, alpha-olefinsulfonate, and fatty alcohol sulfates.

Suitable nonionic surfactants are, for example, those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark Pluronic (BASF), and other like nonionic compounds. Silicone surfactants can also be used.

Suitable cationic surfactants include, for example, amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, 2-alkyl-1-(2-hydroxyethyl)-2-imidazoline; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, naphthylene-substituted quaternary ammonium chloride such as dimethyl-1-naphthylmethylammonium chloride. The cationic surfactant can be used to provide sanitizing properties.

Suitable zwitterionic surfactants include, for example, betaines, imidazolines, amine oxides, and propinates.

If the concentrated detergent composition is intended to be used in an automatic dishwashing or warewashing machine, the surfactants selected, if any surfactant is used, can be those that provide an acceptable level of foaming when used inside a dishwashing or warewashing machine. It should be understood that warewashing compositions for use in automatic dishwashing or warewashing machines are generally considered to be low-foaming compositions.

Suitable bleaching agents include, for example, peroxygen compounds, such as alkali metal percarbonates, in particular sodium percarbonate, alkali metal perborates, alkali metal persulfates, urea peroxide, hydrogen peroxide; and hypochlorites, such as sodium hypochlorite or calcium hypochlorite. These compounds may be used, for example, as sodium lithium, potassium, barium, calcium, or magnesium salts. In another embodiment, the peroxygen source is an organic peroxide or hydroperoxide compound. According to a further embodiment, the peroxygen source is hydrogen peroxide prepared in situ using an electrochemical generator or other means of generating hydrogen peroxide in-situ.

Alkali metal percarbonates are particularly preferred bleaching agents. The bleaching agent may be present in an amount of 5 to 60% by weight based on the total weight of the concentrated detergent composition, preferably 5 to 50% by weight, most preferably 10 to 40% by weight.

If the detergent composition includes a peroxygen compound, an activating agent may be included to further increase the activity of the peroxygen compound. Suitable activating agents include sodium-4-benzoyloxy benzene sulphonate (SBOBS); N,N,N',N'-tetraacetyl ethylene diamine (TAED); sodium-1-methyl-2-benzoyloxy benzene-4-sulphonate; sodium-4-methyl-3-benzoyloxy benzoate; SPCC trimethyl ammonium toluyloxy benzene sulphonate; sodium nonanoyloxybenzene sulphonate, sodium 3,5,5,-trimethyl hexanoyloxybenzene sulphonate; penta acetyl glucose (PAG); octanoyl tetra acetyl glucose and benzoyl tetracetyl glucose. The concentrated detergent composition may comprise an activating agent or a mixture of activating agents at a concentration of 1 to 8% by weight based on the total weight of the concentrated detergent composition, preferably 2 to 5% by weight.

The detergent composition may comprise further chelating/sequestering agents in addition to the complexing agents mentioned above. Suitable additional chelating/sequestering agents are, for example, citrate, aminocarboxylic acid, condensed phosphate, phosphonate, and polyacrylate. A chelating agent in the context of the present invention is a molecule capable of coordinating (i.e., binding) the metal ions commonly found in natural water to prevent the metal ions from interfering with the action of the other detersive ingredients of a cleaning composition. Chelating/sequestering agents can generally be referred to as a type of builder. The chelating/sequestering agent may also function as a threshold agent when included in an effective amount. The concentrated detergent composition can include 0.1 to 70% by weight of a chelating/sequestering agent based on the total weight of the concentrated detergent composition, preferably 5 to 60% by weight, more preferably 5 to 50% by weight, most preferably 10 to 40% by weight.

Polyacrylates and polymaleates are particularly preferred additional components of the detergent composition of the present invention. In a preferred embodiment, the concentrated detergent composition therefore also comprises a polyacrylate, polymethacrylate, and/or polymaleate.

Suitable aminocarboxylic acids include, for example, N-hydroxyethyliminodiacetic acid, nitrilotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Examples of condensed phosphates include sodium and potassium orthophosphate, sodium and potassium pyrophosphate, sodium hexametaphosphate, and the like. A condensed phosphate may also assist, to a limited extent, in solidification of the composition by fixing the free water present in the composition as water of hydration.

The composition may include a phosphonate such as 1-hydroxyethane-1,1-diphosphonic acid $CH_3C(OH)[PO(OH)_2]_2$(HEDP); amino tri(methylenephosphonic acid) $N[CH_2PO(OH)_2]_3$; aminotri(methylenephosphonate), sodium salt $(NaO)(HO)P(OCH_2N[CH_2PO(ONa)_2]_2)$; 2-hydroxyethyliminobis(methylenephosphonic acid) $HOCH_2CH_2N[CH_2PO(OH)_2]_2$; diethylenetriaminepenta(methylenephosphonic acid) $(HO)_2POCH_2N[CH_2CH_2N[CH_2PO(OH)_2]_2]_2$; diethylenetriaminepenta(methylenephosphonate), sodium salt $C_9H_{(28-x)}N_3Na_xO_{15}P_5$ (x=7); hexamethylenediamine(tetramethylenephosphonate), potassium salt $C_{10}H_{(28-x)}N_2K_xO_{12}P_4$ (x=6); bis(hexamethylene) triamine(pentamethylenephosphonic acid) $(HO_2)POCH_2N[(CH_2)_6N[CH_2PO(OH)_2]_2]_2$; and phosphorus acid $H_3PO_3$.

Preferred phosphonates are 1-Hydroxy Ethylidene-1,1-Diphosphonic Acid (HEDP), aminotris(methylenephosphonic acid) (ATMP) and Diethylenetriamine penta(methylene phosphonic acid) (DTPMP).

A neutralized or alkaline phosphonate, or a combination of the phosphonate with an alkali source prior to being added into the mixture such that there is little or no heat or gas generated by a neutralization reaction when the phosphonate is added is preferred. The phosphonate can comprise a potassium salt of an organo phosphonic acid (a potassium phosphonate). The potassium salt of the phosphonic acid material can be formed by neutralizing the phosphonic acid with an aqueous potassium hydroxide solution during the manufacture of the solid detergent. The phosphonic acid sequestering agent can be combined with a potassium hydroxide solution at appropriate proportions to provide a stoichiometric amount of potassium hydroxide to neutralize the phosphonic acid. A potassium hydroxide having a concentration of from about 1 to about 50 wt % can be used. The phosphonic acid can be dissolved or suspended in an aqueous medium and the potassium hydroxide can then be added to the phosphonic acid for neutralization purposes.

The chelating/sequestering agent may also be a water conditioning polymer that can be used as a form of builder. Exemplary water conditioning polymers include polycarboxylates. Exemplary polycarboxylates that can be used as water conditioning polymers include polyacrylic acid, maleic/olefin copolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers.

The concentrated detergent composition may include the water conditioning polymer in an amount of 0.1 to 20% by weight based on the total weight of the concentrated detergent composition, preferably 0.2 to 5% by weight.

Silicates may be included in the concentrated detergent composition as well. Silicates soften water by the formation of precipitates that can be easily rinsed away. They commonly have wetting and emulsifying properties, and act as buffering agents against acidic compounds, such as acidic soil. Further, silicates can inhibit the corrosion of stainless steel and aluminium by synthetic detergents is and complex phosphates. A particularly well suited silicate is sodium metasilicate, which can be anhydrous or hydrated. The concentrated detergent composition may comprise 1 to 10% by weight silicates based on the total weight of the concentrated detergent composition.

The composition can include an effective amount of detergent fillers or binding agents. Examples of detergent fillers or binding agents suitable for use in the present composition include sodium sulfate, sodium chloride, starch, sugars, and $C_1$-$C_{10}$ alkylene glycols such as propylene glycol. The detergent filler may be included an amount of 1 to 20% by weight based on the total weight of the concentrated detergent composition, preferably 3 to 15% by weight.

A defoaming agent for reducing the stability of foam may also be included in the composition to reduce foaming. The defoaming agent can be provided in an amount of 0.01 to 20% by weight based on the total weight of the concentrated detergent composition.

Suitable defoaming agents include, for example, ethylene oxide/propylene block copolymers such as those available under the name Pluronic N-3, silicone compounds such as silica dispersed in polydimethylsiloxane, polydimethylsiloxane, and functionalized polydimethylsiloxane, fatty amides, hydrocarbon waxes, fatty acids, fatty esters, fatty alcohols, fatty acid soaps, ethoxylates, mineral oils, polyethylene glycol esters, defoaming emulsions and alkyl phosphate esters such as monostearyl phosphate.

The composition can include an anti-redeposition agent for facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. The anti-redeposition agent can be included in an amount of 0.01 to 25% by weight based on the total weight of the concentrated detergent composition, preferably 1 to 5% by weight.

The composition may include enzymes that provide desirable activity for removal of protein-based, carbohydrate-based, or triglyceride-based soil. Although not limiting to the present invention, enzymes suitable for the cleaning composition can act by degrading or altering one or more types of soil residues encountered on crockery thus removing the soil or making the soil more removable by a surfactant or other component of the cleaning composition. Suitable enzymes include a protease, an amylase, a lipase, a gluconase, a cellulase, a peroxidase, a catalase, or a mixture thereof of any suitable origin, such as vegetable, animal, bacterial, fungal or yeast origin. The concentrated detergent composition may comprise 0.01 to 30% by weight enzymes based on the total weight of the concentrated detergent composition, preferably 0.01 to 15% by weight, more preferably 0.01 to 10% by weight, most preferably 0.01 to 8% by weight.

Examples of proteolytic enzymes which can be employed in the cleaning composition of the invention include (with trade names) Savinase®; a protease derived from *Bacillus lentus* type, such as Maxacal®, Opticlean®, Durazym®, and Properase®; a protease derived from *Bacillus licheniformis*, such as Alcalase®, Maxatase®, Deterzyme®, or Deterzyme PAG 510/220; a protease derived from *Bacillus amyloliquefaciens*, such as Primase®; and a protease derived from *Bacillus alcalophilus*, such as Deterzyme APY. Exemplary commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; those sold under the tradenames Deterzyme®, Deterzyme APY, and Deterzyme PAG 510/220 by Deerland Corporation, and the like.

Preferred proteases will provide good protein removal and cleaning performance, will not leave behind a residue, and will be easy to formulate with and form stable products. Savinase®, commercially available from Novozymes, is a serine-type endo-protease and has activity in a pH range of 8 to 12 and a temperature range from 20° C. to 60° C. Savinase is preferred when developing a liquid concentrate. A mixture of proteases can also be used. For example, Alcalase®, commercially available from Novozymes, is derived from *Bacillus licheniformis* and has activity in a pH range of 6.5 to 8.5 and a temperature range from 45° C. to 65° C. And Esperase®, commercially available from Novozymes, is derived from *Bacillus* sp. and has an alkaline pH activity range and a temperature range from 50° C. to 85° C. A combination of Esperase and Alcalase is preferred when developing a solid concentrate because they form a stable solid. In some embodiments, the total protease concentration in the concentrate product is from about 1 to about 15% by weight, from about 5 to about 12% by weight, or from about 5 to about 10% by weight. In some embodiments, there is at least 1-6 parts of Alcalase for every part of Esperase (e.g., Alcalase:Esperase of 1:1, 2:1, 3:1, 4:1, 5:1, or 6:1).

Detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease is preferably at least 80% homologous, preferably having at least 80% sequence identity, with the amino acid sequences of the proteases in these references.

Mixtures of different proteolytic enzymes may be incorporated into the disclosed compositions. While various specific enzymes have been described above, it is to be understood that any protease which can confer the desired proteolytic activity to the composition may be used.

The disclosed compositions can optionally include different enzymes in addition to the protease. Exemplary enzymes include amylase, lipase, cellulase, and others.

Exemplary amylase enzymes can be derived from a plant, an animal, or a microorganism. The amylase may be derived from a microorganism, such as a yeast, a mold, or a bacterium. Exemplary amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant).

Exemplary amylase enzymes include those sold under the trade name Rapidase by Gist-Brocades® (Netherlands); those sold under the trade names Termamyl®, Fungamyl® or Duramyl® by Novo; those sold under the trade names Purastar STL or Purastar OXAM by Genencor; those sold under the trade names Thermozyme® L340 or Deterzyme® PAG 510/220 by Deerland Corporation; and the like. A mixture of amylases can also be used.

Exemplary cellulase enzymes can be derived from a plant, an animal, or a microorganism, such as a fungus or a bacterium. Cellulases derived from a fungus include the fungus *Humicola insolens, Humicola* strain DSM1800, or a cellulase 212-producing fungus belonging to the genus Aeromonas and those extracted from the hepatopancreas of a marine mollusk, Dolabella Auricula Solander. The cellulase can be purified or a component of an extract, and either wild type or variant (either chemical or recombinant).

Examples of cellulase enzymes include those sold under the trade names Carezyme® or Celluzyme® by Novo; under the tradename Cellulase by Genencor; under the tradename Deerland Cellulase 4000 or Deerland Cellulase TR by Deerland Corporation; and the like. A mixture of cellulases can also be used.

Exemplary lipase enzymes can be derived from a plant, an animal, or a microorganism, such as a fungus or a bacterium. Exemplary lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Exemplary lipase enzymes include those sold under the trade names Lipase P "Amano" or "Amano-P" by Amano Pharmaceutical Co. Ltd., Nagoya, Japan or under the trade name Lipolase® by Novo, and the like. Other commercially available lipases include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*. A preferred lipase is sold under the trade name Lipolase® by Novo. A mixture of lipases can also be used.

Additional suitable enzymes include a cutinase, a peroxidase, a gluconase, and the like. Exemplary cutinase enzymes are described in WO 8809367 A to Genencor. Exemplary peroxidases include horseradish peroxidase, ligninase, and haloperoxidases such as chloro- or bromo-peroxidase. Exemplary peroxidases are also disclosed in WO 89099813 A and WO 8909813 A to Novo. These additional enzymes can be derived from a plant, an animal, or a microorganism. The enzyme can be purified or a component of an extract, and either wild type or variant (either chemical or recombinant). Mixtures of different additional enzymes can be used.

Various dyes, odorants including perfumes, and other aesthetic enhancing agents can be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keystone Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), and Acid Green 25 (Ciba-Geigy).

Fragrances or perfumes that may be included in the compositions include, for example, terpenoids such as citronellol, aldehydes such as amyl cinnamaldehyde, a jasmine such as C1S-jasmine or jasmal, and vanillin.

The concentrated detergent composition may be provided, for example, in the form of a solid, a powder, a liquid, a gel or a paste. Preferably, the concentrated detergent composition is provided in the form of a solid or a powder.

The components used to form the concentrated detergent composition can include an aqueous medium such as water as an aid in processing. It is expected that the aqueous medium will help provide the components with a desired viscosity for processing. In addition, it is expected that the aqueous medium may help in the solidification process when is desired to form the concentrated detergent composition as a solid. When the concentrated detergent composition is provided as a solid, it can, for example, be provided in the form of a block or pellet. It is expected that blocks will have a size of at least about 5 grams, and can include a size of greater than about 50 grams. It is expected that the concentrated detergent composition will include water in an amount of 0.001 to 50% by weight based on the total weight of the concentrated detergent composition, preferably 2 to 20% by weight.

When the components that are processed to form the concentrated detergent composition are processed into a block, it is expected that the components can be processed by a known solidification technique, such as for example extrusion techniques or casting techniques. In general, when the components are processed into a block, the amount of water present in the concentrated detergent composition should be 0.001 to 40% by weight based on the total weight of the concentrated detergent composition, preferably 0.001 to 20% by weight. If the components are processed by extrusion techniques, it is believed that the concentrated detergent composition can include a relatively smaller amount of water as an aid for processing compared with the casting techniques. In general, when preparing the solid by extrusion, it is expected that the concentrated detergent composition can contain 0.001 to 20% by weight water based on the total weight of the concentrated detergent composition. When preparing the solid by casting, it is expected that the amount of water is 0.001 to 40% by weight based on the total weight of the concentrated detergent composition.

In a second aspect the present invention relates to a use solution of the concentrated detergent composition. The use solution is an aqueous solution of 0.1 to 10 g concentrated detergent composition per liter of the aqueous solution, preferably 0.2 to 5 g/l, most preferably 0.5 to 1.5 g/l.

Due to the synergy achieved by the inventive combination of complexing agents it is possible to formulate a use solution on the basis of hard water. The term "hard water" used herein is defined based on the concentration of $CaCO_3$. According to the US Geological Survey, water having a concentration of at least 61 mg/l $CaCO_3$ is qualified as moderately hard water, a concentration of at least 121 mg/l $CaCO_3$ is qualified as hard water, and a concentration of at least 181 mg/l $CaCO_3$ as very hard water.

Generally the present invention is not limited to the case of hard water. In a preferred embodiment, however, the water used to prepare the use solution has a hardness of at least 50 mg/l $CaCO_3$, more preferably at least 61 mg/l $CaCO_3$, even more preferably at least 85 mg/l, most preferably at least 121 mg/l.

In a third aspect the present invention also relates to the use of a concentrated detergent composition as described above as a warewashing detergent for the removal of tea and coffee soil. This soil is characterized by the presence of oxidized polyphenols and calcium silicates. The concentrated detergent composition may therefore be generally be used as a warewashing detergent for the removal of solid comprising oxidized polyphenols and calcium silicates.

Preferably, the concentrated detergent composition is diluted at a concentration of 0.1 to 10 g of concentrated detergent composition per liter of the final solution, preferably 0.2 to 5 g/l, most preferably 0.5 to 1.5 g/l to provide a use solution. Importantly, the present invention allows to use hard water for dilution of the detergent composition. In a preferred embodiment, the concentrated detergent composition is therefore diluted with water having a hardness of at least 50 mg/l $CaCO_3$, more preferably at least 61 mg/l $CaCO_3$, even more preferably at least 85 mg/l, most preferably at least 121 mg/l to provide a use solution.

EXAMPLES

The following examples illustrate the invention by testing the removal of tea and coffee soil from ceramic tiles.

Ceramic tiles (5.1×15.2 cm white, glazed ceramic tiles) were stained with tea soil (Lipton brand tea) according to the following procedure. Hard water having a hardness of >249.9 mg/l $CaCO_3$ was heated to >71° C. The tea was then mixed into the hot hard water. The ceramic tiles were then immersed into the tea for 1 min and then taken out for 1 min to dry. This procedure was repeated until a stain was formed, which was typically after 25 cycles. The tiles were then cured for 48 hrs at room temperature. At this time the tiles are ready for testing.

Cleaning test were carried out in a standard automatic dishwasher. The cleaning efficiency was evaluated by visually and by digital image analysis, comparing the amount of soil left on the tiles after one full cleaning cycle to the amount of soil on the tiles before the cleaning procedure. The results were rated according to the percentage of stain removal.

To determine the breakpoint concentration of individual complexing agents, cleaning tests were performed with detergent use solutions comprising varying amounts of the complexing agent, 400 ppm NaOH, and 30 ppm polyacrylate (Acusol 445 ND). The breakpoint concentration was defined as the minimum concentration of the complexing agent required to achieve a stain removal of at least 90% in a single washing cycle. Table 1 shows the breakpoint concentrations determined for sodium tripolyphosphate (STPP), the sodium salt of methylglycine diacetic acid (MGDA), and the sodium salt of glutamic acid diacetic acid (GLDA). Please note that, in the following, the amounts of MGDA and GLDA are based on the respective sodium salts.

TABLE 1

Breakpoint concentrations of different complexing agents.

| Complexing agent | Breakpoint concentration (ppm) |
|---|---|
| STPP | 405 |
| MGDA | 200 |
| GLDA | 225 |

Based on the individual breakpoint concentrations and assuming that the contributions of individual complexing agents are additive, the theoretically required amount of complexing agents in a detergent composition comprising a mixture of complexing agents can be calculated. For instance, 305 ppm of STPP would theoretically provide 305/405=75% of complexing agent activity needed for breakpoint results. The remaining 25% could theoretically be covered by 0,25×200 ppm=50 ppm MGDA. Alternatively, the remaining 25% could be covered by 33 ppm MGDA (equivalent to 33/200=16.5% of required activity) and 20 ppm GLDA (20/225=8.9%). Table 2 gives the theoretically required amounts of complexing agents in a use solution comprising varying amounts of STPP and at least one additional complexing agent.

TABLE 2

Theoretically required concentrations of combinations of complexing agents to achieve breakpoint results.

| STPP (ppm) | MGDA (ppm) | GLDA (ppm) |
|---|---|---|
| 305 | 33 | 20 |
| 275 | 43 | 24 |
| 278 | 42 | 24 |
| 278 | 62 | |
| 278 | | 70 |

Cleaning tests were performed with detergent use compositions comprising 400 ppm NaOH, 30 ppm polyacrylate (Acusol 445 ND), varying amounts of STPP, and varying amounts of MGDA and/or GLDA. The resulting soil removal is shown in table 3.

TABLE 3

Percentage of soil removal after one cleaning cycle with a use solution comprising 400 ppm NaOH, 30 ppm polyacrylate (Acusol 445 ND) and the indicated amounts complexing agents.

| Example | STPP (ppm) | MGDA (ppm) | GLDA (ppm) | Soil removal |
|---|---|---|---|---|
| 1 | 305 | 26 | 16 | 100% |
| 2 | 275 | 23 | 14 | 99% |
| 3 | 278 | 24 | 14 | 99% |
| 4 | 278 | 38 | | 100% |
| 5 | 278 | | 38 | 100% |

The data in table 3 show that 99% of soil removal can be achieved by combinations of complexing agents, even though the individual amounts are lower than the theoretically required minimum (see table 2). In particular, the difference between the theoretically required amount and the actually required amount of MDGA in a STPP/MDGA mixture is 24 ppm (38.7%). In the case of GLDA in a GLDA/STPP mixture the difference is 32 ppm (45.7%).

What is claimed is:

1. A concentrated detergent composition comprising:

a) an alkali metal hydroxide, b) an alkali metal tripolyphosphate, and c) at least one complexing agent selected from the group consisting of methylglycinediacetic acid and glutamic acid N,N-diacetic acid, wherein the molar ratio of the sum of glutamic acid N,N-diacetic acid, methylglycinediacetic acid, and alkali metal tripolyphosphate to alkali metal hydroxide is 0.01 to 1; and wherein said detergent composition does not comprise any alkali metal carbonates or amylase enzymes.

2. The concentrated detergent composition according to claim 1, wherein the composition comprises methylglycinediacetic acid and glutamic acid N,N-diacetic acid.

3. The concentrated detergent composition according to claim 1, wherein the molar ratio of alkali metal tripolyphosphate to the sum of alkali metal tripolyphosphate, methylglycinediacetic acid, and glutamic acid N,N-diacetic acid is 0.05 to 0.95.

4. The concentrated detergent composition according to claim 1, wherein the composition comprises at least 5% by weight alkali metal hydroxide.

5. The concentrated detergent composition according to claim 1, wherein the alkali metal hydroxide is sodium hydroxide.

6. The concentrated detergent composition according to claim 1, wherein the alkali metal tripolyphosphate is sodium tripolyphosphate.

7. The concentrated detergent composition according to claim 1, wherein the composition provides a pH of at least 9 when diluted in distilled water at a concentration of 1 g/l and measured at a temperature of 20° C.

8. The concentrated detergent composition according to claim 1, wherein the composition further comprises at least one of the compounds selected from the group consisting of surfactants, bleaching agents, activating agents, chelating/sequestering agents, silicates, detergent fillers or binding agents, defoaming agents, anti-redeposition agents, protease, lipase, gluconase, cellulase, peroxidase, catalase, dyes, odorants, catalysts, threshold polymers, soil suspension agents, antimicrobials and mixtures thereof.

9. The concentrated detergent composition according to claim 1, wherein the composition further comprises a polyacrylate, polymethacrylate, and/or polymaleate.

10. The concentrated detergent composition according to claim 1, wherein the composition is provided in the form of a solid, a powder, a liquid, a gel, or a paste.

11. An aqueous solution comprising 0.1 to 10 g/l of the concentrated detergent composition according to claim 1.

12. A method of warewashing comprising:

obtaining the concentrated detergent composition according to claim 1; and introducing said concentrated detergent composition to soiled dishware, as a warewashing detergent for the removal of soil comprising oxidized polyphenols and calcium silicates.

13. The method according to claim 12, wherein the concentrated detergent composition is diluted to provide a use solution with a concentration of 0.1 to 10 g/l.

14. The method according to claim 12, wherein the warewashing detergent is used for the removal of tea and coffee soil.

* * * * *